United States Patent [19]

Strozier

[11] 4,109,346

[45] Aug. 29, 1978

[54] PIVOT AND SUPPORT MOUNTING ASSEMBLY

[75] Inventor: Robert E. Strozier, Atlanta, Ga.

[73] Assignee: Lawrence Brothers, Inc., Sterling, Ill.

[21] Appl. No.: 801,647

[22] Filed: May 31, 1977

[51] Int. Cl.[2] ..... E05D 7/08

[52] U.S. Cl. ..... 16/151; 16/134; 16/185 V; 160/206

[58] Field of Search ..... 16/151, 185 V, 130, 16/132, 134; 160/206; 49/388

[56] References Cited

U.S. PATENT DOCUMENTS

| | | | |
|---|---|---|---|
| 607,728 | 7/1898 | Barnick | 16/185 V |
| 3,206,794 | 9/1965 | Johnson, Jr. | 16/151 |
| 3,391,723 | 7/1968 | Kirby | 16/151 X |
| 3,597,790 | 8/1971 | Kellems et al. | 16/151 |
| 3,805,324 | 4/1974 | Johnson | 16/134 |
| 3,987,837 | 10/1976 | Hewson | 160/206 |

FOREIGN PATENT DOCUMENTS

| | | | |
|---|---|---|---|
| 1,234,177 | 5/1960 | France | 16/151 |

*Primary Examiner*—James Kee Chi
*Attorney, Agent, or Firm*—Olson, Trexler, Wolters, Bushnell & Fosse, Ltd.

[57] ABSTRACT

There is disclosed a pivot and support mounting arrangement for a pivotal door arrangement which permits the door to be adjusted quite easily with respect to the door frame. The arrangement includes a pintle assembly carried by the door and a support arrangement mounted proximate to a lower corner of the door frame, and receiving a projecting portion of the pintle assembly. The support arrangement includes a bracket having an elongate channel-like opening in which is mounted a pintle support block, and selective engageable means to prevent relative movement. A recess is formed in the pintle support block to receive the pintle end portion, and spring means is associated with the support block tending to bias it upwardly. In the assembled condition the weight of the door will overcome the biasing force provided by the spring and the engageable means will be inter-engaged to preclude movement of the support block relative to the bracket. When it is desired to adjust the door position, the door is lifted and the spring means will produce disengagement of said engageable means, while maintaining a degree of engagement of the pintle end in the block recess. Accordingly, movement of the door will produce movement of the support block relative to the bracket, such that when the door is released the inter-engageable means are re-engaged to establish a new location for the pivot provided by the pintle means.

13 Claims, 6 Drawing Figures

PIVOT AND SUPPORT MOUNTING ASSEMBLY

BACKGROUND OF THE INVENTION

The present invention relates to bi-fold door assemblies, and, in particular, to hardware for the lower pivotal mounting of the jamb door adjacent the jamb of the door frame.

Folding door installations whether comprising two or more panels, are used extensively, in that they provide a relatively inexpensive closure means which does not necessitate excessive room for swinging movement, as is the case with conventionally hinged door installations. With a two-panel folding door assembly, referred to as a bi-fold arrangement, one of the panels, the jamb door, is pivotally mounted adjacent the door jamb. With the other panel, the lead door being hingedly connected to the jamb door and slidably mounted with respect to a track extending at least across the upper width of the door frame. Accordingly, in the open condition, the doors will be folded upon each other with only one of the panels, the jamb door, pivoting with respect to the door frame. Guide mounting and pivot hardware for supporting such panels are well known in the art, and examples thereof can be found in U.S. Pat. Nos. 3,987,837 and 3,866,658.

While the numerous prior art guide mounting and pivot assemblies have proven satisfactory, there is a continued demand for hardware assemblies and components which are economical to fabricate, and which requires less skill and time in order to achieve a proper installation. One installation problem, to which the present invention relates, is that of attaining lateral adjustment of the jamb door with respect to the door frame, in order to attain proper alignment of the jamb and lead door panels with the door frame edge. The present invention further provides a mounting arrangement for pivotally supporting the lower or bottom edge of the jamb door, which enables adjustment of the jamb door with respect to the frame to be accomplished in an extremely easy and simple manner. More specifically, the present invention provides a pintle receiving or support menber that is maintained stationary with respect to a mounting bracket by the weight of the door. However, the point of pivotal connection to the mounting bracket may be altered and a new location established, to attain proper adjustment or alignment, by merely lifting and repositioning the door. As such, adjustment is accomplished without disassembly of either the upper or lower mounting arrangements, without the need for tools, and for that matter, without the individual having to handle or adjust the mounting hardware manually.

The present invention provides a combination support and pivotal mounting arrangement, which includes a pintle assembly carried by the jamb door, a mounting bracket affixed to the lower corner of the door frame, and a pintle support block adjustably carried by the mounting bracket. The pintle support block and the bracket are provided with selectively engageable means that, when engaged, preclude relative movement during normal conditions, but can be disengaged to permit relative movement. More specifically, the present invention includes spring means, which upon assembly of the bracket to the door frame will bias the support block in a direction wherein said inter-engageable means are disengaged to permit relative movement of the block along the channel. When the door is pivotally supported in said block, the weight thereof will overcome the biasing force to produce or re-establish engagement of said means, thereby precluding relative movement. When it is desired to adjust the relative position of the pivot point for the jamb door, it is only necessary to lift the door and reposition it. Upon lifting, the spring will maintain engagement of the block with the pintle assembly, so that movement of the door, per se, also results in movement of the support block relative to the mounting bracket.

The structural and operation features of the present invention, and the advantages attended thereto will become clear from the following detailed description of a preferred embodiment, illustrated in the accompanying drawings.

DESCRIPTION OF THE ILLUSTRATED EMBODIMENT

Figure 1:
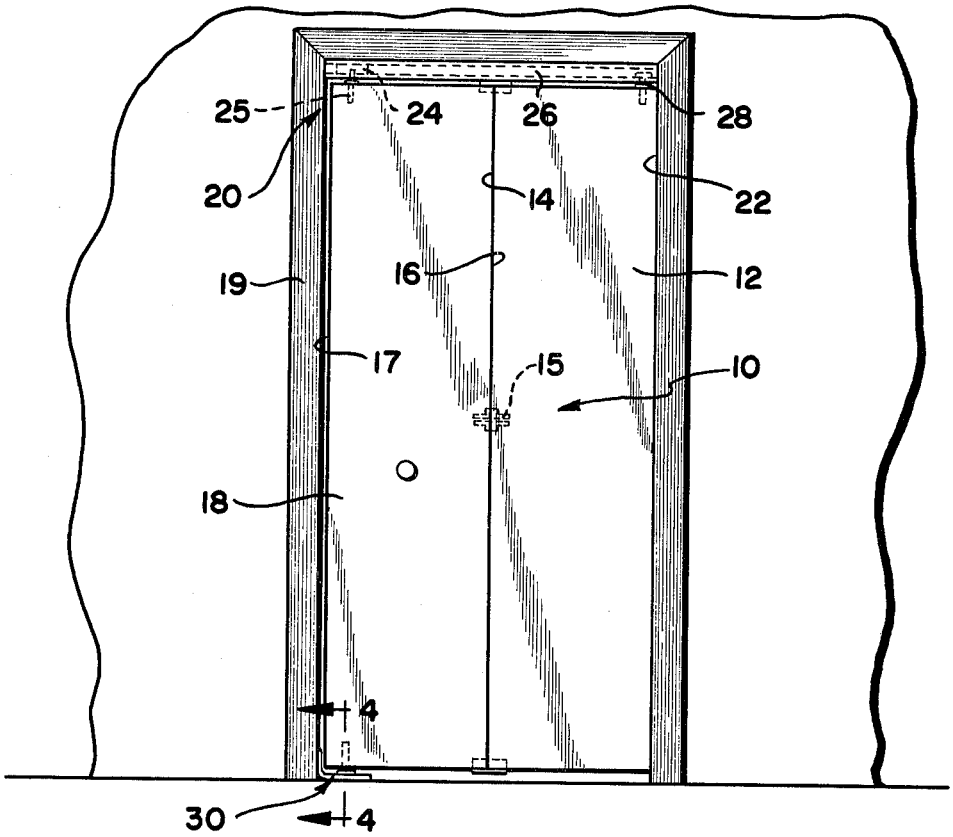
FIG. 1 is an elevational view of a bi-fold door mounted in a door frame.

Referring now to the drawings, and in particular to FIG. 1, there is illustrated a bi-fold door assembly 10 comprising a lead door 12 pivotally connected along a vertical edge 14 by a hinge 15 to the adjacent vertical edge 16 of a jamb door 18. The opposite vertical edge 17 of the jamb door 18 is pivotally mounted adjacent the jamb portion 19 of the door frame 20, which defines the doorway or opening 22. The upper left-hand corner of the jamb door 18, as viewed, is pivotally connected to a header element 24 secured within a track or channel 26, mounted along the upper horizontal edge of the frame 20. In this regard, a pintle pin assembly 25, similar to that to be discussed hereinafter relative to the lower pivotal connection is carried by the jamb door 18 and engaged with header 24 to provide for pivotal movement of the door 18. The right-hand upper edge of the lead door 12 has a guide plug 28 secured thereto which is slidably and rotatably mounted to the track 26. Proximate the left-hand, lower edge of the jamb door 18, there is provided a pivotal mounting, designated generally 30, to which the present invention relates, and which will be detailed more specifically hereinafter.

With the generally overall arrangement of FIG. 1, when it is desired to open the bi-fold door 10, the jamb door 18 is pivoted outwardly about the pivot points provided by the mounting assembly 30 and 24, with the edges 16 and 14 of the jamb door 18 and lead door 12 moving out of the plane of the drawings. Correspondingly, the edge of the lead door 12, opposite edge 14, which is slidably connected to track 26 by the pin 28 will move toward the door jamb 19, with the mounting of the pin 28 in the track 26, providing for both sliding and pivotal movement of said door. Thus, in the fully open condition, the jamb door 18 and lead door 12 will be folded over in superposed relation.

If desired, the doorway threshold may be provided with an additional track, (not shown) with the lower, righthand edge of the lead door 12 slidably connected thereto in a manner similar to that employed at 28, relative to the upper portion of said lead door.

As was alluded to previously in the introductory portion of the specification, the present invention relates to the lower pivot and support assembly 30 for the bottom edge of the jamb door 18. Assembly 30, not only pivotally mounts the jamb door 18 relative to the door frame 20, but enables the pivot point to be moved toward or away from the jamb portion 19, in order to plumb or properly align the doors. Accordingly, since the hardward utilized in the upper pivotal mounting of the jamb door 18, and the slidable mounting of the lead door 12 are not part of the present invention, and there exists numerous known designs for said hardware, these arrangements have not been illustrated in detail, and correspondingly will not be discussed. It is to be understood, however, that any of a number of conventional mounting arrangements may be utilized in this regard.

Attention is now directed specifically to the construction of the pivot and support assembly 30 which provides for adjustment of the lower pivot point for jamb door 18 relative to the door frame 20, without disassembly of the respective components.

Figure 2:
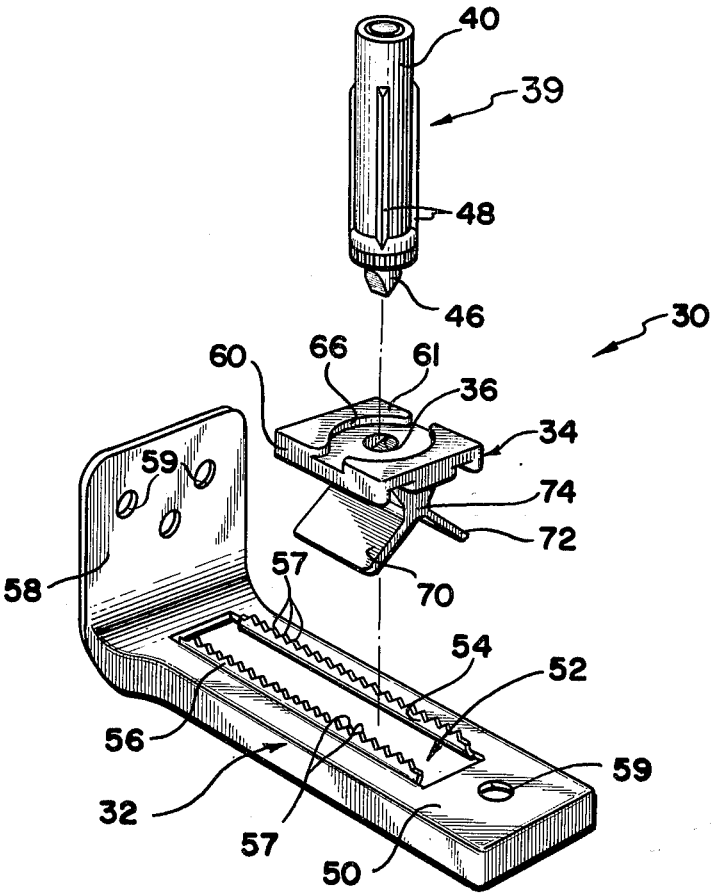
FIG. 2 is an exploded perspective view of the lower pivotal mounting and support assembly of the present invention.
Figure 3:
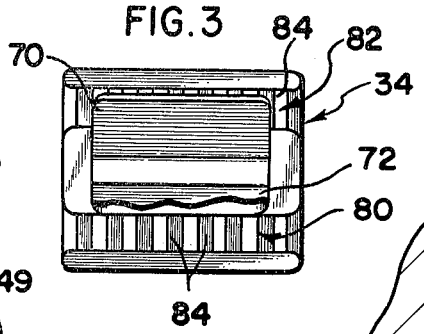
FIG. 3 is a plan view of the underside of the pintle support block, with one of the spring leafs broken away to illustrate in greater detail the serrated bottom of said block.

The respective elements which comprise the pivot and support assembly 30 can be viewed separately in FIG. 2, with the assembled condition for said components being illustrated in FIG. 3. In this regard, the pivot and support assembly 30 includes a bracket 32 which is adapted to be mounted proximate the lower corner of the frame 20 and the threshold, and to which is adjustably and slidably mounted a pintle support block 34, the specific details of both to be considered more fully hereinafter. The pintle support block 34 has a recess 36 in the upper surface thereof which receives the projecting end portion of a pintle assembly 39, designed to be carried by the jamb door panel 18.

Figure 4:
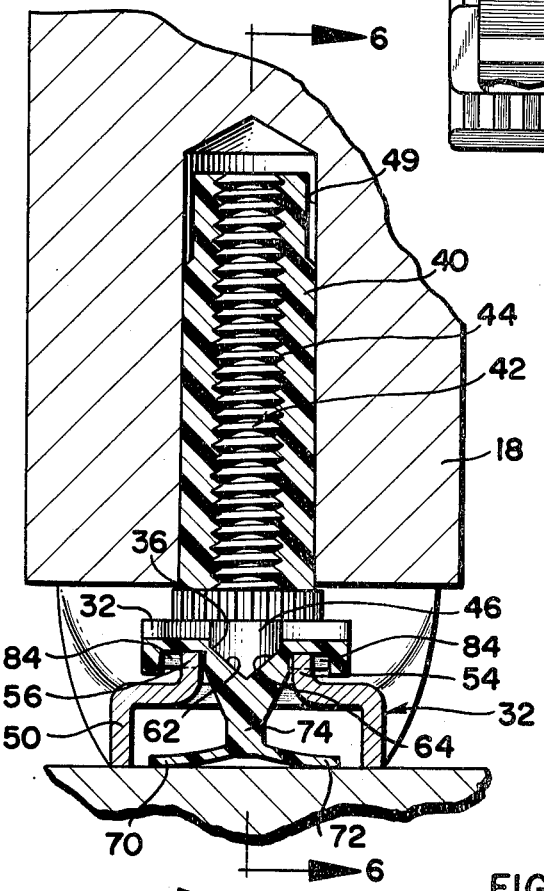
FIG. 4 is a sectional view taken along the line 4—4 of FIG. 1 illustrating the mounting arrangement of the present invention with the door in the normal operating condition.

The pintle assembly 39 can best be viewed in FIG. 4, and includes an outer housing 40 that is internally threaded and engaged with a threaded segment 44 of a pintle member 42. In addition to the threaded segment 44, the pintle member 42 includes a projecting end portion 46 which as will be discussed, is adapted to be non-rotatably received in the recess 36 provided in the support block 34. The housing 40 includes a plurality of axially extending ribs 48, FIG. 5, which are adapted to be engaged in a bore 49 provided in the door panel 18 to prevent rotation of the housing 40 with respect to the door 18.

Thus, since the housing 40 will move with the door, and pintle 42 is fixed to the support block 34, the threaded engagement of the housing 40 with the pintle member 42 in effect provides the bearing or journalling surfaces which enable the door 18 to pivot with respect to the jamb 19. More specifically as the door 18 is opened, the relative rotation of the respective threadedly engaged surfaces on housing 40 and pintle member 42, will produce a slight rising of the door 18. The pitch of the threads is selected, so that this movement is inconsequential and does not produce any adverse effect. This movement, may also be accommodated by the upper pivot assembly 24, 25. Movement of the door from the open to the closed condition, will of course produce relative rotation in the opposite direction, returning the housing 40 and door 18 to the conditions as illustrated in FIG. 4.

Specific attention is now directed to the construction of the mounting bracket 32 and the pintle support block 34. In addition to the specific construction of these elements, the manner in which they cooperate to provide the improved results discussed above will also be considered hereinafter.

Figure 6:
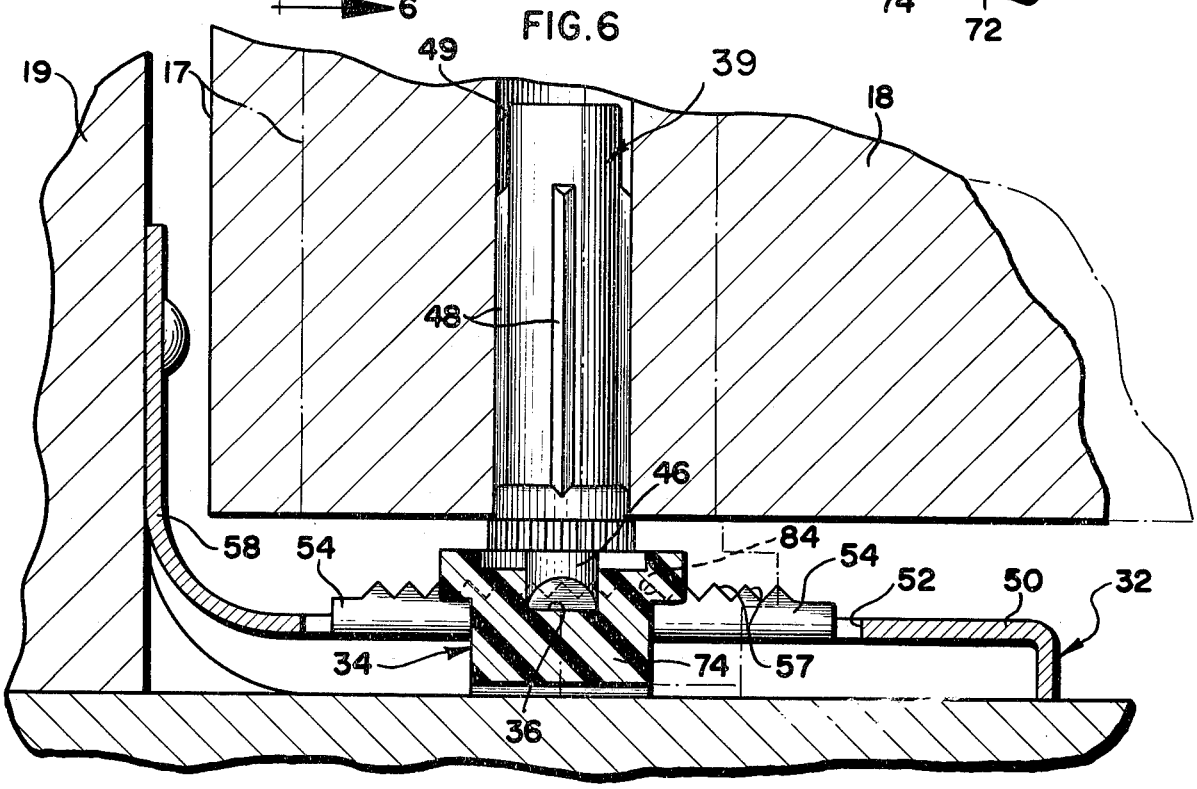
FIG. 6 is a sectional view taken along the line 6—6 of FIG. 4, and illustrating in phantom, the movement of said pivot point in relation to the door frame.

With reference initially to FIG. 2, it can be seen that the bracket 32 includes an elongate base section 50, having a slot or rectangular channel 52 formed therein with the elongate edges 54 and 56 of said slot being upturned to provide flange-like projections having a plurality of serrations 57 formed thereon. A transverse mounting flange 58 may be included proximate one end of the base 50, and both said mounting flange 58 and the base 50 may be provided with a number of mounting apertures 59 which permit the bracket 32 to be affixed to the door frame and the threshold, proximate a lower corner of said door frame, as illustrated in FIG. 6.

The pintle pin support block 34, includes a base or main section 60 having an upper surface 61 in which the aforementioned recess 36 is formed to receive the projecting end 46 of the pintle member 42. In the illustrated embodiment, the recess 36 includes bevelled side walls 62 and 64, FIG. 4, which mate and cooperate with the bevelled tip of the projecting end 46 of the pintle pin, in such a manner as to prevent relative rotation between the pintle pin 42 and the support block 34. While the illustrated type of inter-engagement is preferred, it is envisioned that alternate forms of non-rotating, mating engagement may be employed, as are well known in the art. It should be noted further, that the upper surface 61 of the support block may also be formed with an additional recessed portion 66, FIG. 2, to insure accommodation of the flange portion on the pintle pin 42.

Extending downwardly from the base section 60 are a pair of diverging, resilient, leaf-like projections 70 and 72. The projections 70 and 72 are joined to the base section 60 by a relatively thin intermediate section 74, and extend from said intermediate section at an obtuse angle. Accordingly, as will become clear from the description of the overall operation of the mounting and pivot assembly 30, the diverging projections 70 and 72 are resilient or flexible, and cooperate to provide spring or biasing means for the entire support block 34.

As an additional and important feature illustrated in FIG. 3, the underside 78 of the base section 60 of the support block 34 is provided with two parallel rows 80 and 82 of teeth or serrations 84, designed to be engaged and cooperate with the serrations 55 on the upturned edges 54 and 56 of the bracket. It can be appreciated, that when the respective serrated surfaces 80 and 82 are in engagement with the upturned edges 54 and 56, as shown in FIG. 6, relative sliding movement of the block 34 along the channel 52 is prohibited. The significance of this feature will become apparent from the discussion to follow regarding the overall operation of assembly 30.

Attention is now directed to the operational features of the pivot and support assembly 30, as said assembly augments the installation and subsequent adjustment of the bi-fold door assembly 10. In the mounting of the bi-fold door 10, the track 26 is installed initially, and the jamb door 18 pivotally connected to said track by use of the header assembly 24 carried by said track, and the pintle means 25. Preparatory to mounting of the jamb door 18, the bracket 32, with the support block 34 disposed in slot 52, is mounted at the lower corner of the door frame, and the pintle assemblies 38 and 25 are engaged in pre-drilled apertures in the bottom and upper edges of the jamb door 18. Accordingly, after attachment of the door to the header assembly 24, and keeping in mind, that the assembly 24 can accommodate slight relative upward movement of the door 18, the door 18 can be raised and the projecting end 46 of pintle pin 42 engaged in the bevelled recess 36 of the support block 34 to in effect pivotally mount the left-hand edge of the jamb door 18, as viewed.

When the jamb door 18 is released, the weight of the door will force the support bracket 34 downwardly to bring the serrations 84 on the underside of the support block 34 into engagement with the corresponding serrations 55 on the upturned edges 54 and 56, FIG. 6, thus fixing the position of the support block 34, and the pivot point provided thereof, relative to the bracket 32. As an additional matter, the weight of the jamb door 18 forcing the support block 34 downwardly, will also cause the resilient leaf-like projections 70 and 72 to be engaged with the underlying threshold, to flex or spread said projections from their normal position, FIG. 2, to that as shown in FIG. 4. It will be recalled that the projections 70 and 72 are resilient, and thus due to their tendency to return to their original shape, an upwardly directed biasing force is imported to the entire support block 34. This force, however, is easily overcome by the weight of the jamb door 18.

As an additional matter, the flexibility of the leaf-like projections 70 and 72 also facilitate assembly of the support block 34 to the bracket 32. In this regard, one of the projections 70 or 72 is engaged in the channel 52, and the block 34 moved toward the desired, assembled position. The other of said projections will engage the adjacent edge 54 or 56 and will flex and pass inwardly of the channel 52. Since the intermediate section 74 is of lesser width than the channel 52, the support block 34 is free to slide therealong, however, the effective width of both projections 70 and 72 is greater than the width of channel 52, and said projections serve to maintain assembly of the support block 34 in channel 52.

After the jamb door 18 is mounted, the lead door 12 then may be connected both to the jamb door by means of the hinge 15, and to the track 26 by the slidable connection 28. If desired, additional hinge connection at the top and bottom edges of the doors may be utilized.

Once the bi-fold door assembly 10 has been assembled in the doorway 22, it generally will be necessary to adjust the position of the jamb door 18 with respect to the frame 20, either to plumb the doors, or accommodate any irregularities in the doors and/or the door frame. The adjustment of the lower pivot point provided by the assembly 30, requires only movement of the support block 34 relative to the stationary bracket 32. To attain this movement with the present invention, it is only necessary to lift upwardly on the jamb door 18, as represented by the arrows 90 in FIG. 5, and move the jamb door 18 either toward or away from the door frame jamb portion 12 to the desired position, and then release said door. As will become clear hereinafter, the acts of lifting, moving and releasing the jamb door 18 will result in automatic repositioning of the support block 34 with respect to the bracket 32, without disruption of the engagement of the pintle pin 42 in the mounting block recess 36.

Figure 5:
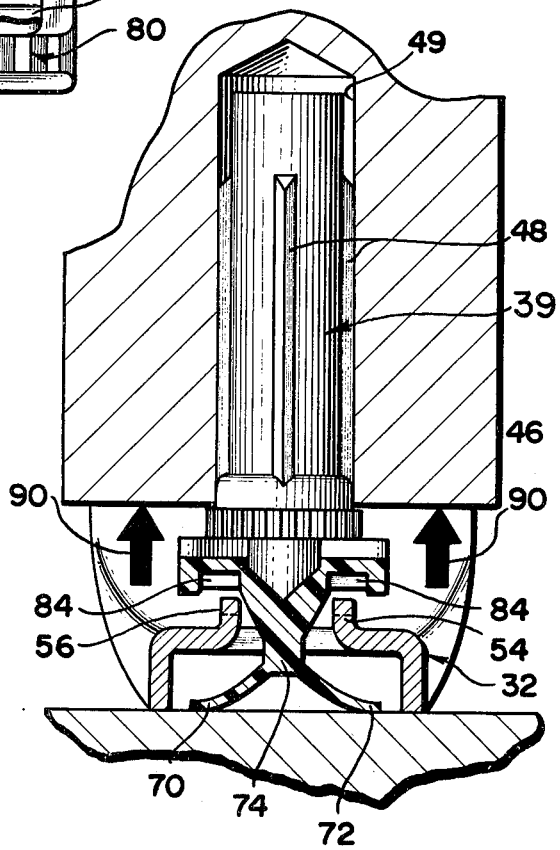
FIG. 5 is a view similar to FIG. 4 illustrating the condition of the parts upon the application of an upward force to the door preparatory to movement of the pivot point in relation to the door frame.

More specifically, when the jamb door 18 is raised, as shown in FIG. 5, the weight of the door is removed from the block 34, and the resilient leafs 70 and 72 tend to return to their original position which results in a forcing of the support block 34 upwardly relative to the bracket 32, as shown in FIG. 5. This upward movement of the support block 34 frees the serrations 84 from engagement with the serrations 55 on the upturned edges 54 and 56. It should be kept in mind, however, that the permitted degree of upward movement of the door is small and is determined by the mounting assembly 24, and is generally known or can be adjusted. Accordingly, the spring or biasing force provided by the projections 70 and 72 is selected not only to free the support block 34 from engagement with the serrated edges 54 and 56 of the bracket, but also to continue to bias support block 34 into engagement with the projecting end 46 of pintle assembly 38, thus maintain the disposition of the tip thereof in the recess 36 upon reaching the upper limit of movement for door 18. Thus, it should be noted that upon lifting of the door 18, the support block 34 is free of any restrictive engagement with the bracket 32, while remaining in engagement with the pintle assembly 38. Accordingly, as the jamb door 18 is moved toward or away from the frame 20, the support block 34 will move therewith, sliding along the channel 52 of the bracket 32. When the desired position for the door is attained, and the door is released, the weight of the door will force the support block 34 downwardly, then re-engages the serration 84 with the serrated edges 54 and 56 of the bracket, thereby establishing a new relative position for the pivot point, as is shown in phantom in FIG. 6.

Thus, it is believed clear that the mounting and pivot assembly 30 of the present invention provides numerous advantages and improved operational features over similar types of mounting arrangements. More specifically, with the prior art designs, the door normally had to be raised and then either held by another party, or supported in some manner, while the elements of the support assembly were re-adjusted manually. With the pivot and mounting assembly 30 in accordance with the present invention, plumbing of the door is attained by simply lifting, moving and releasing the door, thereby obviating any manipulation, disassembly or reassembly of the elements of the mounting arrangement, and also permitting said repositioning without the use of any tools, special skills or handling of the individual parts. It should be also noted, that with the present invention, the weight of the door serves to maintain the engagement between the support blocks and the bracket, and thus resist inadvertent or accidental movement. Also, these advantages are achieved with an extremely simple, reliable structure that can be fabricated at a relatively low cost.

While a preferred form of the present invention, has been illustrated, it is envisioned that those skilled in the art, once aware of the present invention, may devise various modifications, by way of example only, alternate forms of biasing and/or inter-engageable means may be employed from those as illustrated. Insofar as said modifications fall within the spirit and scope of the invention as defined by the claims appended hereto, they are intended to cover by said invention.

The invention is claimed as follows:

1. A support assembly for use in a door pivot arrangement for a door, or the like, of the type which includes pintle means carried by said door and engaged with said support assembly, said support assembly comprising; a bracket adapted for mounting relative to a door frame and including elongate channel means formed therein; a support block mountable to said bracket and including a portion positionable in said channel, said support block including recess means for receiving the pintle means carried by said door; inter-engageable means on said bracket and said support block which when engaged resist relative movement of said support block with respect to said bracket, while permitting said relative movement upon disengagement thereof; and spring means adapted to exert a biasing force on said support block when said support assembly is in the assembled condition, said force being exerted in a direction which will tend to produce disengagement of said inter-engageable means, while maintaining the engagement of said pintle means in said recess means, such that when the force exerted by the door on said support block is relieved, movement of said door relative to said bracket will produce relative movement of said support block along said channel.

2. A support assembly according to claim 1, wherein said spring means comprises at least one resilient member carried by said support block, such that in the assembled condition, said member is resiliently flexed to produce said biasing force on said support block.

3. A support assembly according to claim 2, wherein said at least one resilient member, includes a pair of diverging, resilient projections formed integral with said support block, which projections are spread in the assembled condition, and tend to return to their unstressed condition thereby establishing said biasing force.

4. An assembly according to claim 1, wherein said inter-engageable means comprise serrations formed on said bracket means and said support block.

5. A support assembly according to claim 1, wherein said bracket includes a pair of relatively parallel, upturned flanges providing edges housing a plurality of upwardly directed serrations formed thereon, and said support block includes an undersurface, having corresponding, downwardly facing serrations formed thereon adapted to cooperate with said serrations on said upturned edges, to provide said inter-engageable means.

6. An assembly according to claim 1, wherein said spring means comprises a pair of diverging, resilient projections formed integral with said support block, and an intermediate section on said support block joining said projection to an upper base section thereof, such that when said support block is assembled with respect to said bracket, said base section will be disposed on one side thereof, with said projections on the opposite side thereof, and said intermediate portion disposed in said channel, with said flexible projection permitting said assembly, and providing said spring means and biasing force.

7. A combination pivot and support assembly for the pivotal mounting of a door or the like, with respect to a door of same said assembly comprising; pintle means adapted to be carried by said door and providing a pintle projection adapted to extend from the lower edge of said door; a bracket adapted for mounting relative to a door frame and including elongate channel means formed therein; a pintle support block including a portion thereof adapted to be positioned in said channel and including recess means for receiving said pintle means; inter-engageable means on said bracket and said pintle support block which when engaged resist relative movement of said support block along said bracket channel, while permitting said relative movement when disengaged; and spring means adapted to exert a biasing force on said support block when said assembly is in the assembled condition, said force being exerted in a direction tending to produce a disengagement of said inter-engageable means, such that subsequent to assembly, the door may be lifted with said spring means producing disengagement of said inter-engageable means while maintaining the engagement of said recess means and said pintle means, so that movement of the door toward or away from the door frame will produce corresponding relative movement of said support block with respect to said channel, and releasing of said door will re-establish engagement of said inter-engageable means to fix the position of said pintle support block.

8. A combination pivot and support assembly according to claim 7 wherein said spring means comprises at least one resilient member carried by said support block, such that in the assembled condition, said member is resiliently flexed to produce said biasing force on said support block.

9. A combination pivot and support assembly according to claim 8, wherein said at least one resilient member, includes a pair of diverging, resilient projections formed integral with said support block, which projections are spread in the assembled condition, and tend to return to their unstressed condition thereby establishing said biasing force.

10. A combination pivot and support assembly according to claim 7, wherein said inter-engageable means comprise serrations formed on said bracket means and said support block.

11. A combination pivot and support assembly according to claim 7, wherein said bracket includes a pair of relatively parallel, upturned flanges providing edges housing a plurality of upwardly directed serrations formed thereon, and said support block includes an undersurface, having corresponding, downwardly facing serrations formed thereon adapted to cooperate with said serrations on said upturned edges, to provide said inter-engageable means.

12. A combination pivot and support assembly according to claim 7, wherein said pintle arrangement includes an internally threaded housing adapted to be secured to a door, a pintle member including an externally threaded portion engaged with said internally threaded housing, to provide for relative movement between said housing and said pintle member, and said pintle member including an end portion recessed in said pintle support block recesses, and means for preventing relative rotation of said end portion with respect to said support block.

13. In combination, a door frame, a door assembly including at least one door pivotally mounted with respect to said frame, and mounting means for the mounting of said door, said mounting means including a combination pivot and support assembly for the pivotal mounting of the lower edge of said door with respect to said door frame, said assembly comprising; a pintle arrangement to be carried by said door and providing a pintle projection extending from the lower edge of said door; a bracket mounted relative to a lower corner of the door frame and including elongate channel means formed therein; a pintle support block positioned in said channel and including recess means for receiving said pintle means; inter-engageable means on said bracket and said pintle support block which in the assembled condition are engaged to resist relative movement of said support block along said bracket channel, while permitting said relative movement when disengaged; and spring means exerting a biasing force on said support block tending to produce a disengagement of said inter-engageable means, such that the door may be lifted with said spring means biasing said support block upwardly to produce disengagement of said inter-engageable means while maintaining the engagement of said recess means and said pintle means so that movement of the door toward or away from the door frame will produce corresponding relative movement of said support block with respect to said channel, and releasing of said door will re-establish engagement of said inter-engageable means to fix the position of said pintle support block.

* * * * *